US005870989A

United States Patent [19]

Takahashi et al.

[11] Patent Number: 5,870,989

[45] Date of Patent: Feb. 16, 1999

[54] ABRASION RESISTANT VALVE SEAT MADE OF SINTERED ALLOY FOR INTERNAL COMBUSTION ENGINES

[75] Inventors: Teruo Takahashi; Takashi Kawamoto, both of Tochigi-ken, Japan

[73] Assignee: Nippon Piston Ring Co., Ltd., Tokyo-to, Japan

[21] Appl. No.: 985,550

[22] Filed: Dec. 5, 1997

[30] Foreign Application Priority Data

Dec. 11, 1996 [JP] Japan ..... 8-352044
Nov. 4, 1997 [JP] Japan ..... 9-301973

[51] Int. Cl.[6] ..... F01L 3/02

[52] U.S. Cl. ..... 123/188.3; 123/188.8; 75/236; 75/246

[58] Field of Search ..... 123/188.3, 188.8; 75/246, 236; 29/888.4, 888.44; 419/16, 14

[56] References Cited

U.S. PATENT DOCUMENTS

| | | | |
|---|---|---|---|
| 4,080,205 | 3/1978 | Niimi et al. | 75/241 |
| 4,345,943 | 8/1982 | Takahashi et al. | 75/238 |
| 4,485,147 | 11/1984 | Nishino et al. | 428/550 |
| 4,540,737 | 9/1985 | Kazuoka et al. | 123/188.8 |
| 4,671,491 | 6/1987 | Kuroishi et al. | 251/368 |
| 4,724,000 | 2/1988 | Larson et al. | 75/236 |
| 4,734,968 | 4/1988 | Kuroishi et al. | 419/27 |
| 5,080,713 | 1/1992 | Ishibashi et al. | 75/246 |
| 5,158,601 | 10/1992 | Fujiki et al. | 75/246 |
| 5,462,573 | 10/1995 | Baker et al. | 75/231 |
| 5,466,276 | 11/1995 | Sato et al. | 75/231 |
| 5,666,632 | 9/1997 | Maulik | 419/6 |

FOREIGN PATENT DOCUMENTS 51-13093 4/1976 Japan .

*Primary Examiner*—Erick R. Solis
*Assistant Examiner*—Hai Huynh
*Attorney, Agent, or Firm*—Evenson, McKeown, Edwards & Lenahan, P.L.L.C.

[57] ABSTRACT

The invention is directed to an iron series sintered alloy superior in abrasion resistance, preferably usable for slipping parts such as valve seats used in internal combustion engines, vanes in compressors and so forth. The sintered alloy is of base matrix of a mixed structure comprising the primary phase of in area ratio 30~95% mainly of Fe having a hardness of 400 Hv or above with precipitated fine carbide of 10 $\mu$m or smaller, and the secondary phase of in area ratio 5~70% softer than said primary phase, consisted of pure iron or carbon steel or low alloy steel. This base matrix will include in area ratio 1~20% infiltrated or previously added Cu phase or Cu alloy phase, or will include dispersed therein in area ratio 1~20% hard particles having average diameter of 20~100 $\mu$m and a hardnessof 700~1500 Hv such as Fe—Mo paricles, Cr—Mo—Co intermetallic compound particles, C—Cr—W—Co particles, etc.

7 Claims, 5 Drawing Sheets

100 μm

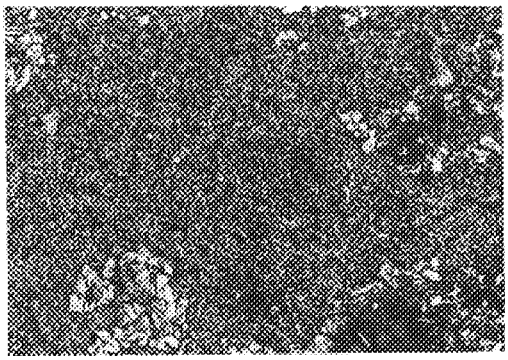
FIG. 1a 100 μm
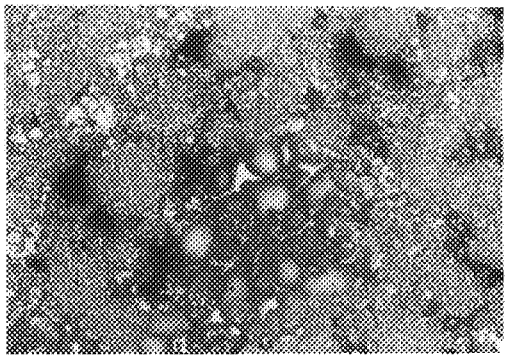
FIG. 1b 100 μm
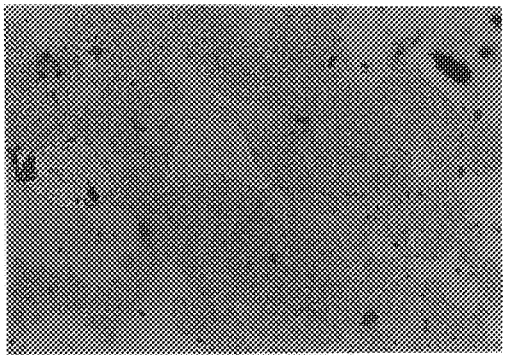
FIG. 1c 100 um
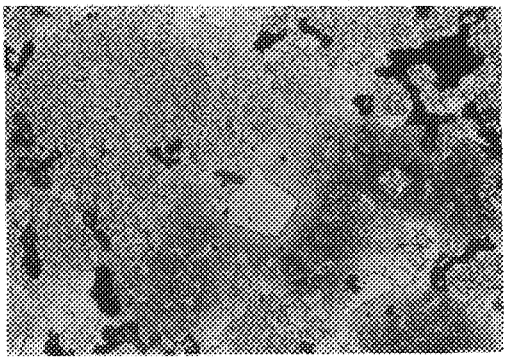
FIG. 1d 100 um 100 μm 100 μm 100 μm 100 μm

ABRASION RESISTANT VALVE SEAT MADE OF SINTERED ALLOY FOR INTERNAL COMBUSTION ENGINES

FIELD OF THE INVENTION

The present invention relates to a valve seat made of sintered alloy used for internal combustion engines, in particular to a valve seat of sintered alloy superior in abrasion resistance.

BACKGROUND OF THE INVENTION

Sintered alloy is produced in a process in which alloy powder is combined and blended, filled into a mould, press-formed, and then sintered in a determined atmosphere and at a determined temperature. According to such sintering method, metals and alloys which are hardly obtained by usual melting and casting method, can be easily produced, and a plurality of functions can be easily obtained together, which enables to produce parts having peculiar function or functions. Also, sintered alloy is adapted for production of porous materials, hard-machining materials and complicated mechanical parts. In recent years, such sintered alloy has been used for valve seats for which high abrasion resistance is required.

Concerning sintered alloys used for valve seats, there was seen Japanese Publication Gazette No.51-13093/1976 of which the entire disclosure is expressly incorporated herein by reference, which discloses an iron series sintered alloy used for valve seats having a high abrasion resistance as well as a heat resisting, anti-corrosion property even under usage of leadless gasoline. This sintered alloy includes a lot of C, Ni, Cr, Mo,Co and W,and also ferromolybdenum particles and special alloy particles consisted of C-Cr-W-Co dispersed in pearitic structure, these particles being accompanied with Cu and Ni dispersed therearound. For such reasons, this sintered alloy needs in particular a lot of W and Co annexed thereto in order to effect the characteristics of high heat resistance, abrasion resistance, anti-corrosion, etc. Therefore, the valve seats made of this sintered alloy will be expensive and thus accompanied with drawbacks at cost.

SUMMARY OF THE INVENTION

An object of the inventaion is to solve advantageously the above mentioned drawbacks and therefore to provide an improved valve seat superior in abrasion resistance made of iron base sintered alloy material used for internal combustion engines.

The present invention provides a valve seat superior in abrasion resistance used for internal combustion engines, made of iron base sintered alloy of mainly matrix consisted of a mixed structure comprising the primary phase formed mainly of Fe with precipitated fine carbide and the secondary phase softer than said primary phase and formed mainly of Fe, wherein said primary phase has 10 μm or smaller precipitated fine carbide and a hardness of 400 Hv or above and also occupies in area ratio 30~95% in the matrix, and said secondary phase occupies in area ratio 5~70% in the matrix.

Also, in a valve seat of the invention, said primary phase preferably includes by weight C:2.0% or less, and one or more selected from a group of Cr:17% or less, Mo:12% or less, W:20% or less,V:6% or less, Ti:3% or less, Nb:3% or less, B:3% or less and Co:13% or less, and the reminder Fe and inevitable impurities, and said secondary phase is preferably composed of pure iron, or carbon steel, or low alloy steel. Furthermore, said secondary phase is preferably composed of pure iron containing by weight 0.5% or less of C, or carbon steel consisted of by weight C:1.5% or less, Mn:0.5% or less, Si:1.0% or less and the reminder Fe and inevitable impurities, or low alloy steel consisted of by weight C:1.5% or less, Mn:0.5% or less, Si:1.0% or less and one or more selected from a group of Cr:4% or less, Mo:3% or less, Co:6% or less, Ni:5% or less, V:1.0% or less and Cu:5.0% or less and the reminder Fe and inevitable impurities.

Furthermore, in a valve seat of the invention, the valve seat will include in area ratio 1~20% of infiltrated or previously added Cu phase or Cu alloy phase, or include dispersed therein in area ratio 1~20% hard particles having average diameter 20~100 μm and a hardness 700~1500 Hv, added in said matrix. Said hard particles are preferabl y consisted of one selected from a group of Fe-Mo particles, Fe-W particles, Cr-Mo-Co intermetallic compound particles and C-Cr-W-Co particles.

Incidentally, in a valve seat of the invention, the valve seat will include in area ratio 0.5~10% of solid lubricant added in the above described matrix. Such solid lubricant is preferably of one of graphite, sulfide, nitride and fluoride.

Also, in a valve seat made of sintered alloy according to the invention, sintered pores will be infiltrated with a metal having a low melting point. The described low melting point metal is preferably of a metal selected from a group of Pb, Pb alloy, Sn, Sn alloy, Zn and Zn alloy.

BRIEF DESCRIPTION OF THE DRAWINGS

FIG. 1 shows optical micrographs of a sintered body embodied by the present invention;

Figure 2A:
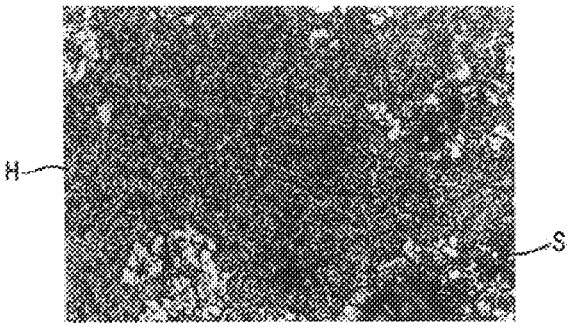
FIG. 2 shows the same micrographs as the FIG. 1, together with reference symbols.
Figure 2B:
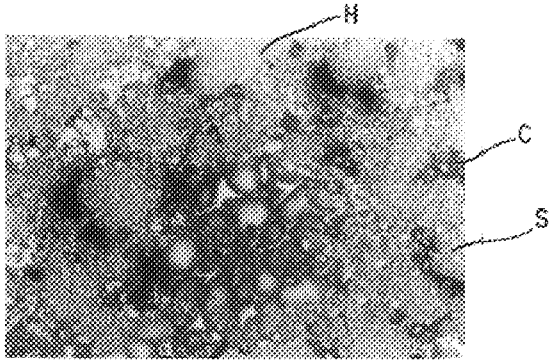
Figure 2C:
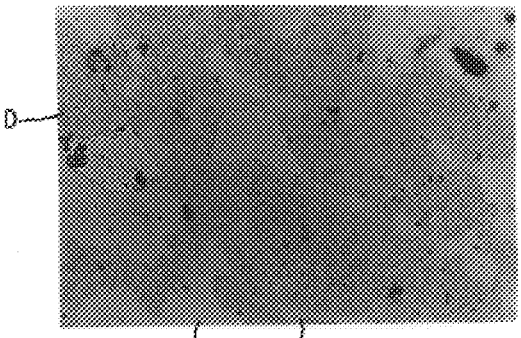
Figure 2D:
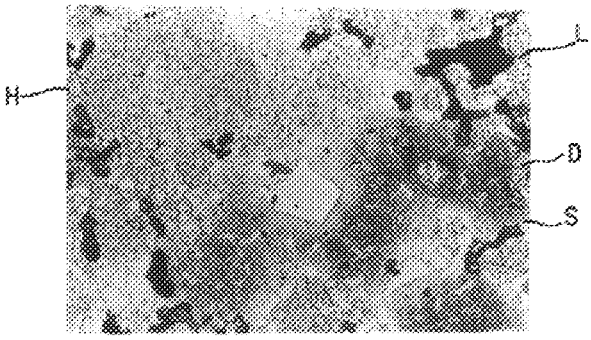

Concerning symbols, H:primary phase, S: secondary phase, C: Cu phase, D: hard particles, L: solid lubricant, A: base matrix

DESCRIPTION OF THE PREFERRED EMBODIMENTS

The invention and advantageous details will now be explained more fully with reference to exemplary embodiments.

A valve seat made of iron series sintered alloy according to the invention is mainly of matrix consisted of a mixed structure including in area ratio 30~95% primary phase formed mainly of Fe with precipitated fine carbide and in area ratio 5~70% secondary phase formed mainly of Fe and softer than the primary phase.

The primary phase includes 10 μm or smaller precipitated fine carbide and has a hardness of 400 Hv or above. If the size of the precipitated fine carbide exceeds 10 μm, its strength is lowered and opposite aggresivility increases. Also, where the hardness is below 400 Hv, its abrasion resistance can not be improved. Incidentally, the size of the fine carbide is preferably 1~5 μm, and the hardness of the primary phase is preferably in a range of 450~900 Hv in point of abrasion resistance, strength and opposite aggresivility. Also, the structure of the primary phase is basically, mainly of a structure with precipitated fine carbide.

Also, the ratio of the primary phase in the matrix is 30~95% in area ratio. If the ratio is below 30%, the abrasion resistance becomes too deteriorative to attain the object of the invention. Otherwise, if it exceeds 95%, the abrasion resistance can not be further improved, which results in economical disadvantage because there is little effect in comparison with quantitative increase of the alloy elements. Further, the ratio of the primary phase in the matrix is preferably in a range of 50~90%.

The composition of the primary phase is preferably consisted of by weight C:2.0% or less and one or more selected from a group of Cr:17% or less, Mo:12% or less, W:20% or less, V:6% or less, Ti:3% or less, Nb:3% or less, B:3% or less and Co:13% or less, and the reminder Fe and inevitable impurities.

We will now explain such reasons for limitations of the preferable constituent compositions of the primary phase.

C: 2.0% or less

C is needed to adjust the phase to a determined structure and hardness and also to form carbide. If it exceeds 2.0%, the melting point decreases and liquid phase is formed thereby to bring liquid phase sintering. This brings too much formation of precipitated carbide and lots of pores, so that this also leads to deterioration of the elongation characteristic and lowering of dimensional accuracy. Also, C is preferably 0.5% or more. If it is less than 0.5%, the sintering is not advanced enough and quantity of the precipitated carbide is so limited that abrasion resistance is lowered. C is more preferably 0.7~1.7%.

Inclusion of one or more selected from a group of Cr, Mo, W, V, Ti, Nb, B and Co.

Cr: 17% or less

Cr is an element to enhance strength, heat resistance and abrasion resistance. If it exceds 17%, precipitated quantity of Cr carbide becomes too much thereby to lower machinability, and the carbide precipitated in the phase will hardly be 10 $\mu$m or smaller fine carbide. Cr is preferably 4% or more. If it is less than 4%, quantity of precipitated carbide decreases. This leads to lowering of abrasion resistance. Cr is more preferably in a range of 4~12%.

Mo: 12% or less

Mo precipitates as carbide or solid solution, and enhances hardness of the phase thereby to increase the abrasion resistance. Otherwise, if it exceeds 12%, powder fluidity is lowered and therefore formability is also lowered. Mo is preferably 3% or more. If it is less than 3%, quantity of precipitated carbide is so limited that the abrasion resistance decreases. Mo is more preferably in a range of 3~6%.

W: 20% or less

W is an element which forms carbide and increases abrasion resistance. If it exceeds 20%, quantity of precipitated carbide increases too much and strength is so enhanced, that elongation property decreases. W is preferably 4% or more. If it is less than 4%, quantity of precipitated carbide lessens, which results in a little decrease in abrasion resistance. W is more preferably in a range of 4~12% and much more preferably 4~7%.

V: 6% or less

V is an element which forms carbide and enhances abrasion resistance. However,if it exceeds 6%, quantity of precipitated carbide increases too much and strength is so enhanced, that elongation property is lowered. V is preferably 1% or more. If it is less than 1%, the quantity of precipitated carbide is so limited that abrasion resistance goes down a little. V is more preferably 2~5%, and much more preferably 2~3%.

Ti: 3% or less

Ti is an element which forms carbide and enhances abrasion resistance. If it exceeds 3%, quantity of precipitated carbide increases too much, which results in a decrease in elongation. Also, Ti is preferably in a range of 0.5~2.0%.

Nb: 3% or less

Nb is, similar to Ti, an element which forms carbide and enhances abrasion resistance. Otherwise, if it exceeds 3%, quantity of precipitated carbide increases too much and therefore brings a decrease in elongation. Incidentally, Nb is preferably 0.5~2.0%.

B: 3% or less

B is an element which modifies the matrix to a predetermined structure together with an element forming carbide, and increases abrasion resistance. If it exceeds 3%, rough precipitated substance is formed, which brings a decrease in abrasion resistance. Incidentally, B is preferably 0.5~2.0%.

Co: 13% or less

Co is an element which increases high temperature strength and improves abrasion resistance by restraining a decrease of hardness which results from an increase in temperature. Otherwise, if it exceeds 13%, such effects can not be further advanced and can not be expected in line with its annexed quantity. Since this leads to economical disadvantage, Co is limited to 13% or less. Furthermore, Co is preferably in a range of 8~10%.

The primary phase includes the reminder substantially consisted of Fe.

We will now explain about the secondary phase.

A valve seat made of sintered alloy according to the present invention includes formation of the secondary phase in order to increase powder compressibility at forming. It is needed for the secondary phase to be softer than the primary phase, and the secondary phase has preferably a hardness of 400 Hv or below. According to the presence of the secondary phase in the iron base matrix, the strength and toughness of the sintered body are much improved in comparison with those of a single hard phase. Also, the secondary phase is economically more advantageous than the primary phase because of less quantity of alloy elements. The secondaray phase is composed mainly of Fe, and is preferably of pure iron, or carbon steel, or low alloy steel.

Also, the secondary phase occupies in area ratio 5~70% in the matrix. If the ratio of the secondary phase is less than 5%, the powder compressibility goes down, whereas if it exceeds 70%, the abrasion resistance is badly influenced. Therefore, the ratio of the secondary phase in the matrix is limited to 5~70%.

The secondary phase is preferably composed of pure iron consisted of by weight 0.5% or less and the reminder Fe and inevitable impurities, or carbon steel consisted of by weight C:1.5% or less, Mn:0.5% or less, Si:1.0% or less and the reminder Fe and inevitable impurities, or low alloy steel consisted of by weight C:1.5% or less, Mn:0.5% or less, Si:1.0% or less and one or more selected from a group of Cr:4% or less, Mo:3% or less, Co:6% or less, Ni:5% or less, Cu:5.0% or less and V:1.0% or less and the reminder Fe and inevitable impurities.

The secondary phase can be suitably selected in accordance with the purpose of use of the valve seat made of sintered alloy. The composition of the secondary phase is preferably comprised of pure iron consisted of by weight 0.5% or less of C and the reminder Fe and inevitable impurities in order to be softer than the primary phase. If C in the secondary phase exceeds 0.5%, it will become easily harder than the primary phase. Accordingly, it was decided to be the upper limit of C in case of pure iron.

Where higher hardness is needed, an addition of alloy elements will attain a desired hardness. In a valve seat of the invention, the alloy elements added into the secondary phase are limited to comparatively a little quantity as mentioned above in view of the purpose.

Also,in case that it is needed for the hardness of the secondry phase to be higher than pure iron, carbon steel is desirably employed. The composition of such carbon steel is preferably consisted of by weight C:1.5% or less, Mn:0.5% or less, Si:1.0% or less and the reminder Fe and inevitable impurities. The reasons for these upper limits are as follows; if C exceeds 1.5%, liquid phase easily occurs, if Mn exceeds 0.5%, sinter diffusibility is reduced, and if Si exceeds 1.0%, similar to the case of Mn, sinter diffusibility is reduced.

Furthermore, where higher hardness of the secondary phase is needed, low alloy steel is preferably employed which is equivalent to the described carbon steel added with alloy elements. Such alloy elements are preferably composed of one or more selected from a group of Cr:4% or less, Mo:3% or less, Co:6% or less, Ni:5% or less, Cu:5.0% or less and V:1.0% or less. These alloy elements serve respectively to enhance hardness of the steel. If one of the elements exceeds their limits, namely Cr:4%, Mo:3%, Co:6%, Ni:5%, Cu:5.0%, or V:1.0%, the hardness becomes too high and equals to the same one as that of the primary phase, so that these values forms upper limits respectively.

Also, in a valve seat made of sintered alloy according to the invention, Cu phase or Cu alloy phase in area ratio 1~20% will be contained into the described matrix. Cu powder or Cu alloy powder will be contained therein in such a way that it is mixed with iron powder, or instead of adding Cu powder or Cu alloy powder at the mixing of powder, Cu powder or Cu alloy powder will be disposed on compressed powder body at the sintering or on sintered body at the heat treatment, and then will be infiltrated into sintered pores.

Cu phase or Cu alloy phase is precipitated into the base matrix to thereby enhance heat conductivity and inter-particle bonding force of sintered body. Incidentally, Cu phase or Cu alloy phase is precipitated in pores and seals the pores whereby to improve elongstion and machinability. If Cu phase or Cu alloy phase is less than 1%, elongation reduces and also machinability of the sintered body goes down. On the other hand, it exceeds 20%, precipitated Cu phase or Cu alloy phase is brought to too large, which results in a decrease of shearing strength and abrasion resistance of the sintered body. Accordingly, Cu phase or Cu alloy phase is limited in a range of 1~20%.

Also, in a valve seat of the invention, instead of pore-sealing treatment with the described Cu or Cu alloy, sintered pores will be infiltrated with a low melting point metal. Such a low melting point metal is preferably of Pb, Pb alloy, Sn, Sn alloy, Zn or Zn alloy. The sintered pores to be infiltrated with a low melting point metal will be in area ratio 1~20%. If it is less than 1%, elongation of the sintered body reduces, whereas if it exceeds 20%, strength of the sintered body goes down.

Also, in a sintered alloy of the invention, hard particles which have average grain-diameter of 20~100 $\mu$m and a hardness of 700~1500 Hv, will be dispersed in a range of 1~20% in area ratio into the described matrix.

Although such hard particles can be expected to effectively elevate abrasion resistance of the sintered alloy, if the average grain-diameter is smaller than 20 $\mu$m, dispersion is apt to occur and therefor the effectiveness for improving abrasion resistance is limited. Otherwise, if it exceeds 100 $\mu$m, machinability is badly influenced, so that the average grain-diameter of the hard particles is limited to 20~100 $\mu$m. Also, if the hardness of the hard particles is below 700 Hv, the effectiveness for improving abrasion resistance is limited, while if it exceeds 1500 Hv, machinability is badly influenced, so that the hardness of the hard particles is limited in a range of 700~1500 Hv.

The hard particles will be disparsed in area ratio 1~20%. If they are less than 1%, the effectiveness for improving abrasion resistance is limited, but if they exceed 20%, machinability and powder compressibility are deteriorated, so that the ratio of the dispersed hard particles will be limited in a range of 1~20%. In a valve seat of the invention, the hard particles are preferably of one of Fe-Mo particles, Fe-W particles, Cr-Mo-Co intermetallic compound particles or C-Cr-W-Co particles.

Fe-Mo particles and Fe-W particles disperse into the matrix by being added with ferromolybdenum powder or ferrotungsten powder. The comosition of ferromolybenum is enough in a range stipulated by JIS. The composition of ferromolybdenum is, for example, of Mo:50~70 wt % and Fe:30~50 wt %, and the comosition of ferrotungsten is, for example, of W:40~60 wt % and Fe:40~60 wt %.

Cr-Mo-Co intermetallic compound particles will be added in a form of intermetallic compound powder composed of Cr:10 wt %, Mo:30 wt % and Co:60 wt %. Also, C-Cr-W-Co particles will be added as a powder composed of C:1~5 wt %, Cr:40~70 wt %, W:10~30 wt % and Co:5~20 wt %.

And, in a valve seat of the invention, solid lubricant can be added into the described matrix in order to improve machinability, abrasion resistance and anti-opposite aggressibility. The solid lubricant is desirably in area ratio 0.5~10%. If it less than 0.5%, its effects can not be expected, but if it exceeds 10%, progress of sintering reaction is hindered thereby to deteriorate mechanical properties. The solid lubricant is preferably of one of graphite, sulfide, nitride and fluoride. Such sulfide is preferably of Mns or $MnS_2$ and the fluoride is preferably of $CaF_2$.

In order to obtain a valve seat made of sintered alloy according to the invention, alloy steel powder forming the primary phase and composed of one or more of a group of Cr, Mo, W, V, Ti, Nb, B and Co and the reminder Fe is blended with steel powder forming the secondary phase and consisted of pure iron or carbon steel or low alloy steel, or together with Cu powder, Cu alloy powder. Incidentally, zinc stearate or the like will be combined as the lubricant.

Furthermore, solid lubricant or ferromolybdenum powder or the like forming hard particles will be added and combined. Next, these powders are filled into a mould and then press-formed by a forming press to form a compressed powder body. And thereafter, the powder body is sintered to a sintered body.

In a process of the invention, the compressed powder body is preferably heated and sintered in a protective atmosphere of a temperature of 1100°–1200° C. If the temperature is below 1100° C., there is caused a lack of sintering diffusion. But if the temperature is higher than 1200° C., over-diffusion of hard particles in the base occurs, which results in a lowering of abrasion resistance.

Also, these sintered bodies will be provided thereon with Cu or Cu alloy or a low melting point metal, and heated thereby for pores to be sealed. After that, the sintered bodies are worked out to valve seats (products) by machining.

EXAMPLES

Alloy steel powder (A~E, J) which forms the primary phase and steel powder (a~d, h) which forms the secondary phase were combined to the composition shown in Table 1, and the following powders, namely, C powder or further Cu powder or Cu alloy powder forming Cu phase, or ferromolybdenum powder or intermetallic comound consisted of Cr, Mo, Co as hard particles, or MnS or graphite or $CaF_2$ as solid lubricant, were combined so as to be the rate shown in Table 1, and furthermore zinc stearate 1% as lubricant was combined therein, and blended, thereafter filled into a mould, press-formed, and sintered at 1150° C.×0.5 hour in an AX-gas atmosphere. After sintering, relevant to some samples, the sintered bodies were infiltrated at 600° C.×1 hour by means of Pb-vacuum impregnation.

Each composition of used alloy steel powders are as follows:

A powder: 0.9 wt % C—4 wt % Cr—5 wt % Mo—6 wt % W—2 wt % V—the reminder Fe (used for Sample No.1, Sample No.5, Sample No.6, Sample No.8, Sample No.10)

B powder: 1.5 wt % C—12 wt % Cr—1 wt % Mo—0.3 wt % V—the reminder Fe (used for Sample No.2, Sample No.7)

C powder: 1.0 wt % C—5 wt % Cr—2 wt % Mo—5 wt % W—2 wt % V—the reminder Fe (used for Sample No.3)

D powder: 1.3 wt % C—12 wt % Cr—1 wt % Mo—0.5 wt % B—the reminder Fe (used for Sample No.4)

E powder: 1.0 wt % C—12 wt % Cr—the reminder Fe (used for Sample No.9)

J powder: 1.3 wt % C—4 wt % Cr—3 wt % Mo—3 wt % V—10 wt % V—10 wt % Co—the reminder Fe (used for Sample No.11)

Each composition of used steel powders forming the secondary phase are as follows:

a powder: 1 wt % Cr—0.3 wt % Mo—the reminder Fe. C of 0.8 wt % was solid-solved in the base matrix. (used for Sample No.1, Sample No.5, Sample No.7, Sample No.9, Sample No.10)

b powder: consisted of pure iron. C of 0.8 wt % was solid-solved in the base matrix. (used for Sample No.2, Sample No.6)

c powder: 3 wt % Cr—0.3 wt % Mo—0.3 wt % V—the reminder Fe. C of 0.8 wt % was solid-solved in the base matrix. (used for Sample No.3, Sample No.8)

d powder: 2 wt % Ni—0.5 wt % Mo—the reminder Fe. C of 0.8 wt % was solid-solved in the base matrix. (used for Sample No.4)

h powder: 2 wt % Ni—4 wt % Co—the reminder Fe. C of 0.8 wt % was solid-solved in the base matrix. (used for Sample No.11)

Metallic structures of the inventive sintered bodies are observed, and some photographs of typical examples of the metallic structures are shown in FIG. 1 and those with reference symbols are shown in FIG. 2.

FIG. 1(*a*) shows a structure of Sample No.1, FIG. 1(*b*) shows a structure of Sample No.5, FIG. 1(*c*) shows a structure of Sample No. 8, and FIG. 1(*d*) shows a structure of Sample No.9. In the figures of FIG. 2, H denotes the primary phase, S: the secondary phase, C: Cu phase, D: hard particles, and L: solid lubricant.

Figure 3A:
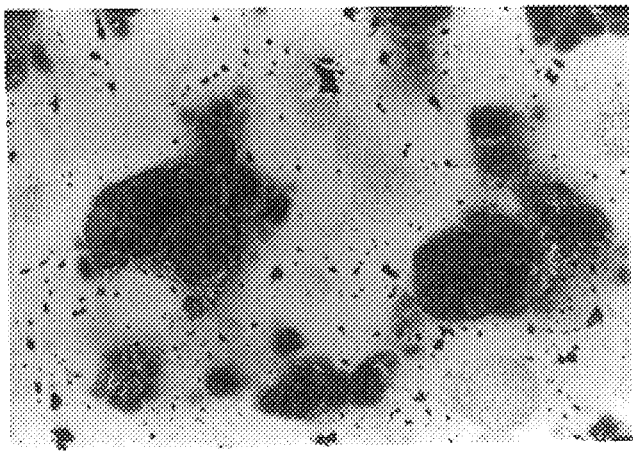
FIG. 3(*a*) is an optical micrograph of a sintered body of a compared example, and (*b*) is the same photograph as the FIG. 3(*a*), together with reference symblos.
Figure 3B:
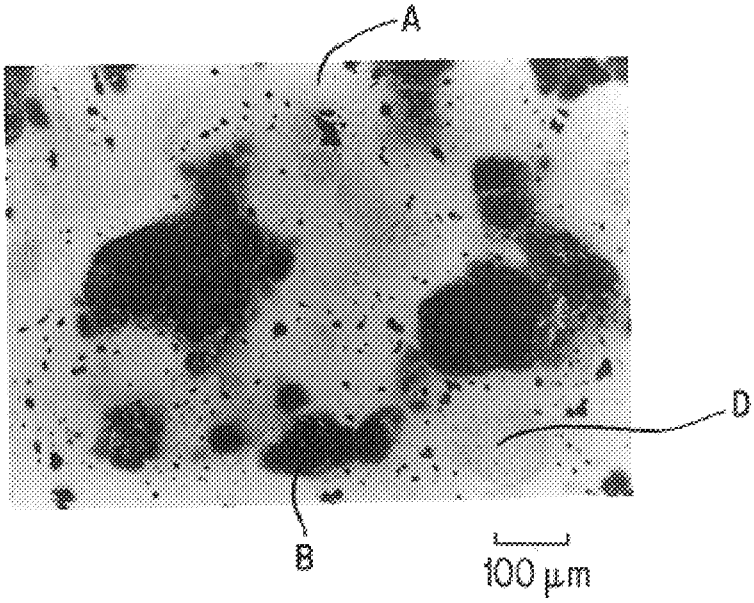

As compared Sample No.1, graphite powder, Ni powder, Co powder and pure iron powder were combined in a such manner that the ratio is 7 wt % Co—2 wt % Ni—Fe, and further added with Cr-Mo-Co intermetallic compound powder as hard particles so that the hard particles occupied 15% in area ratio, and furthermore added with zinc stearate 1%, then blended, thereafter filled into a mould, press-formed, and sintered at 1150° C.×0.5 hour in an AX gas atmosphere. A photograph of metallic structure of this sintered body (Sample No.12) is shown in FIG. 3(*a*). The same photograph with reference symbols is also shown in FIG. 3(*b*). In the FIG. 3(*b*), A denotes base matrix (1 wt % C—7 wt % Co—2 wt % Ni—Fe), B: pearite, and D: hard particles (Cr-Mo-Co intermetallic compound).

Also, as compared Sample No.2, graphite powder, Ni powder, Co powder and pure iron powder were combined in such a manner that the ratio is 6 wt % Co—2 wt % Ni—Fe and furthermore added with alloy powder consisted of C, Cr, W and Co as hard particles so that the hard particles occupied 10% in area ratio, and also added with zinc stearate 1%, then blended,thereafter filled into a mould, press-formed, and sintered at 1150° C.×0.5 hour in an AX gas atmosphere. After that, the sintered body was infiltrated with Cu.

Figure 4A:
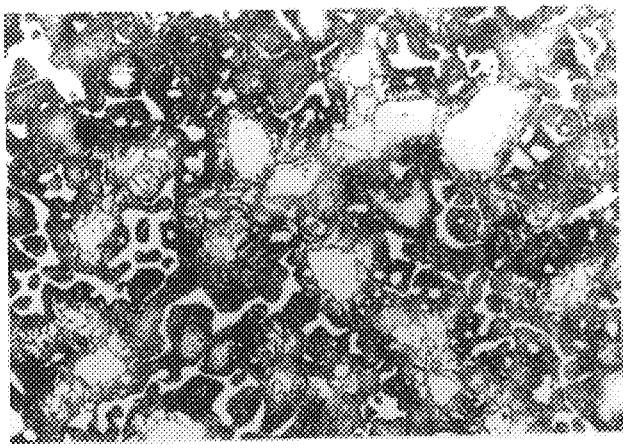
FIG. 4(*a*) is a photograph showing an optical micrograph of a sintered body of another compared example, and (*b*) is the same photograph as the FIG. 4(*a*), together with reference symbols.
Figure 4B:
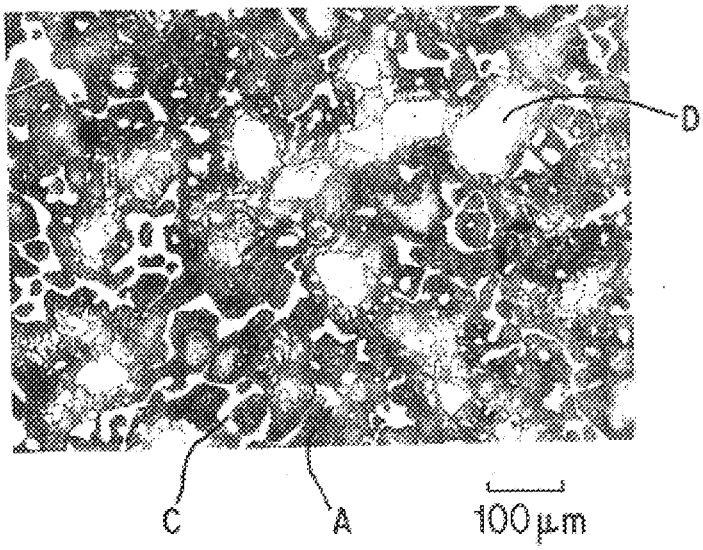

A micrograph of this sintered body (Sample No.13) is shown in FIG. 4(*a*), and the same photograph with reference symbols is shown in FIG. 4(*b*).

In FIG. 4(*b*), A denotes base matrix (1 wt % C—6 wt % Co—2 wt % Ni—Fe), B: Cu phase, D: hard particles (C-Cr-W-Co alloy).

Figure 5:
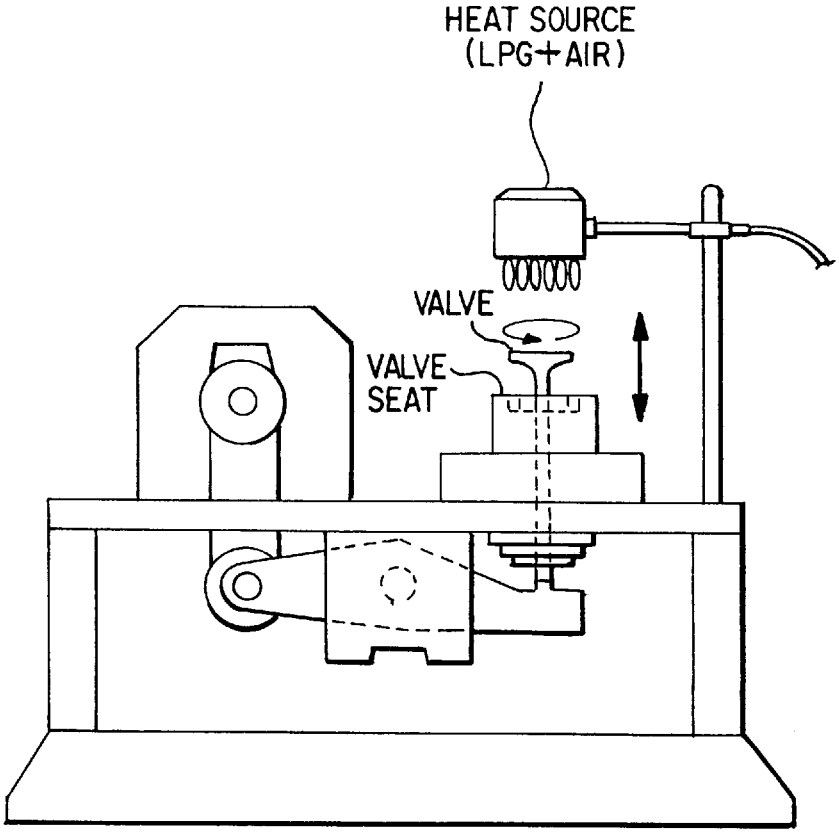
FIG. 5 shows a schematic view of a rig tester.

Sintered bodies embodied by the invention and those of compared examples were worked respectively to valve seats, and tested by means of a rig tester shown in FIG. 5 to carry out abrasion tests under the followinng test conditions described below:

| | |
|---|---|
| test temperature: | 400° C. |
| test time: | 9 hours |
| cam rotary speed: | 3000 rpm |
| valve rotary speed: | 20 rpm |
| spring load: | 35 Kg (at setting) |
| lifted amount: | 7 mm |
| material of valve: | SUH 35 |

After the test, abrasion quantities were measured, and the results were given in Table 1.

As seen in Table 1, relating to the samples of the invention which exist in the scope of the invention, abrasion quantities of both valve seats and valves are limited. Compared to this, relating to compared samples (Sample Nos. 12 and 13) which exist out of the scope of the invention, abrasion quantities of both valve seats and valves are considerable.

TABLE 1

| | iron base matrix | | | | | | | | Cu phase or | | | solid | low melting | quantity of | | |
|---|---|---|---|---|---|---|---|---|---|---|---|---|---|---|---|---|
| | Primary phase | | | | secondary phase | | | | Cu—Co phase | hard particle | | lubricant | point metal | abrasion | | |
| | compo- | area | hard- | | compo- | area | hard- | area | area | composition | area | area | area | (μm) | | |
| Sample No. | sition * | ratio % | ness Hv | carbide μm | sition ** | ratio % | ness Hv | ratio % | ratio % | size μm | ratio % | ratio % | ratio % | valve seat | valve | remarks |
| 1 | A | 70 | 600 | 2 | a | 30 | 350 | 100 | — | — | — | — | — | 8 | 8 | sample of invention |
| 2 | B | 60 | 500 | 4 | b | 40 | 280 | 100 | — | — | — | — | — | 11 | 7 | sample of invention |
| 3 | C | 80 | 550 | 3 | c | 20 | 370 | 100 | — | — | — | — | — | 8 | 7 | sample of invention |
| 4 | D | 50 | 570 | 4 | d | 50 | 300 | 100 | — | — | — | — | Pb 10 | 13 | 8 | sample of invention |
| 5 | A | 70 | 600 | 2 | a | 30 | 350 | 95 | Cu 5 | — | — | — | — | 7 | 3 | sample of invention |
| 6 | A | 70 | 600 | 2 | b | 30 | 280 | 83 | Cu—Co 12 | Cr—Mo—Co 70 | 5 | — | — | 16 | 8 | sample of invention |
| 7 | B | 70 | 500 | 4 | a | 30 | 350 | 99 | — | — | — | MnS 1 | — | 18 | 5 | sample of invention |
| 8 | A | 60 | 600 | 2 | c | 40 | 370 | 80 | — | Fe—Mo 50 | 10 | — | — | 10 | 3 | sample of invention |
| 9 | E | 60 | 450 | 6 | a | 40 | 350 | 95 | — | Fe—Mo 50 | 3 | graphite 2 | — | 10 | 2 | sample of invention |
| 10 | A | 90 | 600 | 2 | a | 10 | 350 | 97 | — | — | — | $CaF_2$ 3 | — | 15 | 5 | sample of invention |
| 11 | F | 60 | 650 | 2 | e | 35 | 300 | 95 | Cu 5 | — | — | — | — | 10 | 9 | sample of invention |
| 12 | base composition: 7Co—2Ni—Fe | | | | | | | 85 | — | Cr—Mo—Co intermetallic compound: 15% | | | — | 25 | 10 | compared sample |
| 13 | base composition: 6Co—2Ni—Fe | | | | | | | 77 | Cu 13 | C—Cr—W—Co alloy particle; 10% | | | — | 35 | 15 | compared sample |

*composition of primary phase
A: 0.9C—4Cr—5Mo—6W—2V—Fe
B: 1.5C—12Cr—1Mo—0.3V—Fe
C: 1.0C—5Cr—2Mo—5W—2V—1Ti—Fe
D: 1.3C—12Cr—1Mo—0.5B—Fe
E: 1.0C—12Cr—Fe
J: 1.3C—4Cr—3Mo—3V—10W—10Co—Fe
**composition of secondary phase
a: 0.8C—1Cr—0.3Mo—Fe
b: 0.8C—Fe
c: 0.8C—3Cr—0.3Mo—0.3V—Fe
d: 0.8C—2Ni—0.5Mo—Fe
h: 0.8C—2Ni—4Mo—Fe According to the present invention, valve seats made of sintered alloy can be inexpensively produced which are superior in abrasion resistance , usable for valve seats used in internal combustion engines driven under severe conditions.

Having now fully described the present invention, it will be understood for one of ordinary skill in the art that many changes and modifications can be made without departing from the spirit or scope of the invention as set forth herein.

The entire disclosure of Japanese Patent Application No.301973/1996 filed on Dec. 11,1996 including specification, claims, drawings and summary are incorporated here by reference in its entirety.

We claim:

1. A valve seat superior in abrasion resistance used for internal combustion engines, made of iron base sintered alloy mainly of matrix consisted of a mixed structure comprising the primary phase formed mainly of Fe with precipitated fine carbide and the secondary phase softer than said primary phase and formed mainly of Fe, wherein said primary phase has 10 $\mu$m or smaller precipitated fine carbide and a hardness of 400 Hv or above and also occupies in area ratio 30~95% in the matrix, and said secondary phase occupies in area ratio 5~70% in the matrix.

2. A valve seat set forth in claim 1, wherein said primary phase includes by weight C:2.0% or less, and one or more selected from a group of Cr:17% or less, Mo:12% or less, W:20% or less, V:6% or less, Ti:3% or less, Nb:3% or less, B:3% or less and Co:13% or less and the reminder Fe and inevitable impurities, and said secondary phase is composed of pure iron, or carbon steel, or low alloy steel.

3. A valve seat set forth in claim 2, wherein said secondary phase is composed of pure iron containing by weight 0.5% or less of C, or carbon steel consisted of by weight C:1.5% or less, Mn:0.5% or less, Si:1.0% or less and the reminder Fe and inevitable impurities, or low alloy steel consisted of by weight C:1.5% or less,Mn:0.5% or less, Si:1.0% or less and one or more selected from a group of Cr:4.0% or less, Mo:3% or less, Co:6.0% or less, Ni:5.0% or less, V:1.0% or less and Cu:5.0% or less and the reminder Fe and inevitable impurities.

4. A valve seat set forth in claim 1, wherein said valve seat includes in area ratio 1~20% of infiltrated or previously added Cu phase or Cu alloy phase.

5. A valve seat set forth in claim 1, wherein said valve seat includes dispersed therein in area ratio 1~20% hard particles having average diameter 20~100 $\mu$m and a hardness 700~1500 Hv, added in said matrix.

6. A valve seat set forth in claim 1, wherein said valve seat includes in area ratio 0.5~10% of solid lubricant added in said matrix.

7. A valve seat set forth in claim 1, wherein sintered pores are infiltrated with a metal having a low melting point.

* * * * *